US006357048B2

(12) United States Patent
Griffiths

(10) Patent No.: US 6,357,048 B2
(45) Date of Patent: Mar. 19, 2002

(54) ONE-PIECE DIVER'S GARMENT

(76) Inventor: John M. Griffiths, 23 Factory St., Montgomery, NY (US) 12549

( * ) Notice: Subject to any disclaimer, the term of this patent is extended or adjusted under 35 U.S.C. 154(b) by 0 days.

(21) Appl. No.: 09/760,650

(22) Filed: Jan. 17, 2001

Related U.S. Application Data

(60) Provisional application No. 60/195,259, filed on Apr. 7, 2000.

(51) Int. Cl.[7] ..... B63C 11/04; B63C 11/10
(52) U.S. Cl. ..... 2/2.17
(58) Field of Search ..... 2/2.17

(56) References Cited

U.S. PATENT DOCUMENTS 2,582,811 A * 1/1952 Williams ..... 2/2.1
3,058,187 A * 10/1962 Gugen ..... 24/201
3,493,972 A * 2/1970 Oldham ..... 2/2.1
3,731,319 A * 5/1973 O'neill ..... 2/2.1 R
4,464,795 A * 8/1984 Long et al. ..... 2/2.1 R
5,802,609 A * 9/1998 Garofalo ..... 2/2.17
5,940,879 A * 8/1999 Whitehouse ..... 2/2.17
6,219,841 B1 * 4/2001 Anderson ..... 2/2.17

* cited by examiner

*Primary Examiner*—John J. Calvert
*Assistant Examiner*—Robert Muramoto, Jr.
(74) *Attorney, Agent, or Firm*—Myron Amer PC

(57) ABSTRACT

A rubber diver's garment with a zip-out front panel flap bounding within the zipper track a relatively large opening approximately coincident in size to the size of the front panel of the upper torso of the garment, which opening by its size and the enlargement thereof afforded by the stretch of the rubber construction material of the garment, readily permits the diver to project arms, legs and neck respectively into the sleeves, leggings and hood seal of the garment without the assistance of another.

1 Claim, 1 Drawing Sheet

FIG. 1
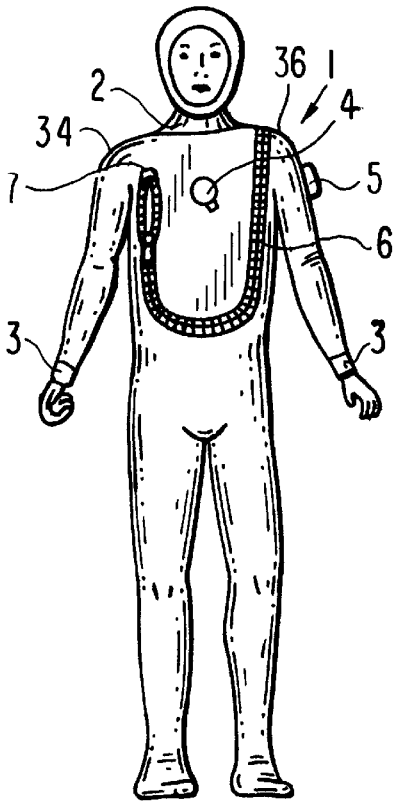
FIG. 2
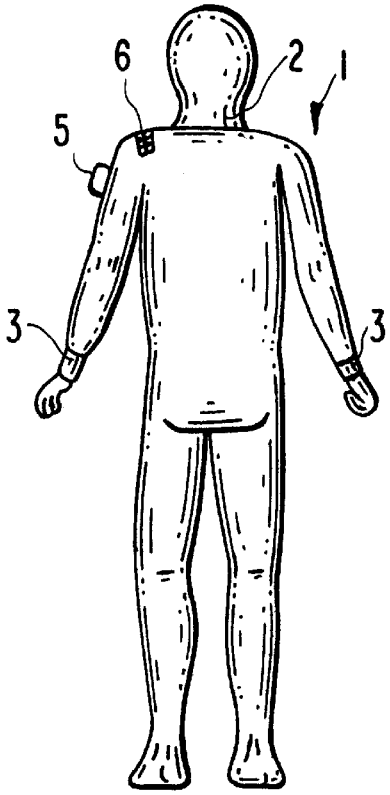
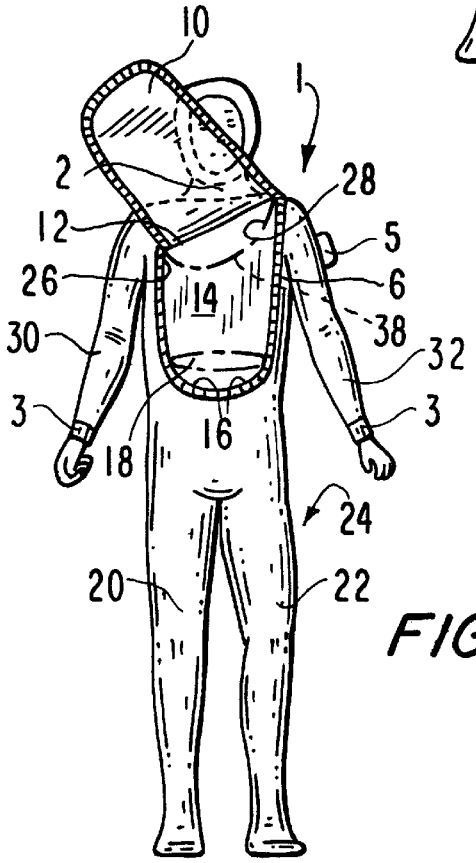
FIG. 3

ONE-PIECE DIVER'S GARMENT

This application claims the benefit of U.S. Provisional Patent Application No. 60/195,259, filed on Apr. 7, 2000, the contents of which are incorporated herein by reference thereto.

The present invention relates to underwater diving suits. Conventional diving suits are cumbersome to put on and take off because they must fit rather snugly when on the diver and are traditionally one piece. A waterproof zipper is positioned on the suit closure that is partially or entirely located on the back of the suit. This makes it impractical for the diver inside this suit to operate the zipper and a second person is required to close the zipper or open the zipper after use. A waterproof zipper can also be located on the front of the suit. In order to function in the front of the suit, the zipper must be as long as possible to allow the diver access to the suit. A long zipper in the front of the suit, however, makes it difficult for the diver to bend forward.

Further, since the zipper is frequently bent, when the diver bends forward or sits with the suit on, the zipper is subject to more stress and can fail causing the suit to leak. Additionally, to accommodate a front zipper, it is common in some suits, such as that subject of U.S. Pat. No. 4,464,795, to provide a telescopic torso that facilitates diver entry and a snug fit. However, a telescopic torso complicates manufacture, requires more material, and increases cost.

It is a primary objective of the present invention to provide a new and improved underwater diving suit that can be quickly and easily put on and taken off by the diver without requiring assistance.

It is another object of the present invention to provide a new and improved underwater diving suit that is simple and inexpensive to manufacture.

It is another object of the present invention to provide such a new and improved underwater diving suit that is attractive in appearance, and has a zipper that does not restrict diver motion and is positioned to prevent damage.

SUMMARY

The problems with the conventional constructions are overcome and the above objectives are attained by an embodiment of the invention by a dry suit for diving that comprises a unitary construction having a lower trunk portion, leg portions integral with the lower trunk portion, upper trunk and neck positions and first and second air portions integral with the upper trunk and neck portions and suit having access means in the upper front portion of the body starting at one shoulder proceeding straight down and curving above the waist straight back up to the opposing shoulder.

Preferably, the diver's garment is formfitting for excluding all water from contact with the body of the wearer. By utilizing the access means in accordance with the present invention, the formfitting nature of the dry suit is preserved while allowing relative ease in the donning and doffing of the garment or suit.

DESCRIPTION OF THE DRAWINGS

FIG. 1 is a front view of the diver's garment;

FIG. 2 is a back view of the diver's garment; and

FIG. 3 is also a front view of the diver's garment illustrating the front flap in an open condition.

DETAILED DESCRIPTION OF THE INVENTION

The present invention provides an underwater diving suit with an opening that allows easy access by the user. A zippered opening runs straight down from one shoulder and curves back to the opposite should resembling a "U" shape.

The preferred embodiment of the present invention is shown in FIGS. 1–3 of the drawing. An underwater diving suit 1 is made of a flexible stretchable material such as sponge rubber or a flexible non-stretchable material, such as trilaminate. A long opening 7 runs from the top of one shoulder directly down and curves before the waist of the diver straight back up to the opposite shoulder. The opening can begin near the top of one shoulder or start substantial back over the shoulder. The end of the opening must extend substantially to the opposite shoulder and can be extended slightly over the shoulder to the back of the diver. Both the beginning and the end of the opening must be easily reached by the diver without any assistance. The opening has a zipper 6 therein for opening and closing the opening.

The suit can have an air inlet valve 4 to allow the suit to be equalized to water pressure during the dive. The suit can also have an outlet value 5 to allow excess pressure inside the suit to vent out during any ascent during a dive.

The suit can have a pair of wrist seals 3 and a neck seal or hood seal 2 to prevent water from entering the suit.

The suit can be integrated with several accessories, including: reflective material on the suit's upper trunk and hood seal; a hood; at least one pocket; a zipper cover, and a pair of knee protectors.

The shape of the opening allows the diver to easily remove the suit without having to provide an extended torso. However, the combination of the access means in accordance with this invention with an extended torso as described in U.S. Pat. No. 4,464,795 provides for a very versatile suit that can adjust to many different diver sizes.

The present invention allows the diver to experience great mobility and the diver's movement does not interfere with the integrity of the zipper while maintaining an attractive appearance. The facilitated manner in which the diver's garment 1 is positioned, unassisted by another, on the diver is best understood from FIG. 3, to which reference should now be made.

As a preliminary step, the diver unzips the zipper 6 which releases a front flap 10, illustrated in phantom perspective, from the front of the upper torso portion of the garment and unfolds the flap 10 along a fold line 12, such that the zipper 6 bounds a relatively large opening 14 into the interior 16 of the garment. The bottom of opening 14, at the level of the waist, and specifically designated 18 is, of course, circumferential in nature and opens into the interiors of depending leggings 20 and 22 of the garment.

Next, the diver projects his/her legs through opening 18 into the leggings 20 and 22 and hikes the garment lower torso portion 4 up to his/her waist.

The result is to advantageously locate upper opposite sides of opening 16, specifically designated 26 and 28, in alignment with the interiors of arm-receiving sleeves 30 and 32 of the garment. The elasticity of the elastomeric or rubber construction material of the garment 1 readily permits the diver to project his/her arms through the openings 26 and 28 opening into the sleeves 30 and 32 and thereafter pull the garment shoulder portions 34 and 36 into their positions in covering relation over the diver's shoulders.

Lastly, the diver is instructed to bow his/her head forward and with both hands stretch the garment in the area of the fold line 12 forwardly in a loop configuration, illustrated in phantom perspective as at 38, and slip the bowed head through the loop 38 to complete providing the garment hood seal 2. Zipper 6 is then closed completing the fitting of the garment 1 on the diver without another's assistance.

While the diver's garment herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method of fitting on an individual a one-piece diver's garment of elastomeric construction material comprising the steps of:

A. using said one-piece diver's garment of a type having a neck opening, integral sleeves and leggings and an upper torso front panel extending from a left to a right shoulder thereof;

B. installing a U-shaped zipper in said upper torso front panel extending from one said shoulder in a descending path along a side of said upper torso front panel to a waist level thereof and in an ascending path along an opposite side of said upper torso front panel to said other shoulder;

C. opening said U-shaped zipper to release an unfolding flap from said front panel folded along a fold line adjacent said neck opening in an angularly oriented relation thereto and wherein said opened zipper bounds a circumferentially shaped first fitting opening located at a bottom length portion of said opening of said U-shaped zipper opening into an interior of said garment leggings;

D. projecting individual's legs through said first fitting opening incident to fitting said leggings on said individual;

E. pulling said leggings up to the waist of said individual to correspondingly raise second fitting openings to a shoulder level opening into said interior of said garment sleeves;

F. projecting individual's arms through said second fitting openings incident to fitting said sleeves on said individual; and G. stretching a peripheral edge adjacent said neck opening delimited between an edge of said neck opening and said fold line of said released flap forwardly and over a bowed individual's head incident to fitting an individual's neck in said neck opening;

H. whereby the fitting on of the garment is attended to by an individual without the assistance of another.

* * * * *